US005080256A

United States Patent [19]

Rockola

[11] Patent Number: 5,080,256

[45] Date of Patent: Jan. 14, 1992

[54] SLANT SHELF MAGAZINE FOR AUTOMATIC VENDING MACHINES

[75] Inventor: Donald C. Rockola, Chicago, Ill.

[73] Assignee: Rock-Ola Manufacturing Corporation, Addison, Ill.

[21] Appl. No.: 467,145

[22] Filed: Jan. 18, 1990

[51] Int. Cl.[5] ..... G07F 11/12

[52] U.S. Cl. ..... 221/109; 221/107; 221/194; 221/289; 221/131; 221/312 R; 193/2 A

[58] Field of Search ..... 221/107, 108, 109, 194, 221/289, 312 R, 312 A, 312 B, 312 C, 131; 193/2 A, 27, 33

[56] References Cited

U.S. PATENT DOCUMENTS

| | | | |
|---|---|---|---|
| 2,336,382 | 12/1943 | Albrecht | 221/194 |
| 2,359,984 | 10/1944 | Garner | 221/194 |
| 2,562,015 | 7/1951 | Cattanach | 221/109 X |
| 2,628,875 | 2/1953 | Ossanna, Jr. | 221/109 X |
| 3,043,474 | 7/1962 | Mullin | 221/195 |
| 3,194,431 | 7/1965 | Garvin | 221/107 X |
| 3,613,946 | 10/1971 | Klem | 221/109 |
| 3,938,700 | 2/1976 | Camp et al. | 221/109 |
| 4,600,120 | 7/1986 | Sabo et al. | 221/107 |
| 4,667,847 | 5/1987 | Tucom | 221/196 |

FOREIGN PATENT DOCUMENTS

| | | | |
|---|---|---|---|
| 1266038 | 4/1968 | Fed. Rep. of Germany | 221/109 |
| 1284855 | 1/1962 | France | 221/109 |

*Primary Examiner*—H. Grant Skaggs
*Assistant Examiner*—C. Druzbick
*Attorney, Agent, or Firm*—McCaleb, Lucas & Brugman

[57] ABSTRACT

A slant-shelf magazine for an automatic, coin controlled, vending machine adapted to dispense cylindrical articles, such as canned or bottled beverages, which are stored and gravitationally fed from plural, parallel, horizontally inclined superposed storage racks into a vertical drop chute located opposite the lower ends of such racks. The drop chute communicates with a horizontally inclined delivery chute having a vend mechanism at its lowermost end for releasing articles one-by-one to a discharge hopper upon customer selection. The delivery chute is oppositely inclined from the storage racks and is joined to the drop chute by an intervening curvilinear guideway formed to reverse the gravitational movement direction of the articles prior to entry into the delivery chute for purposes of reducing article load forces on the vend mechanism.

5 Claims, 2 Drawing Sheets

SLANT SHELF MAGAZINE FOR AUTOMATIC VENDING MACHINES

This invention relates generally to vending machines and more particularly to improvements in slant shelf type magazines adapted to deliver stored articles to a vend mechanism for releasing and delivering unitary items upon customer selection.

BACKGROUND

In a typical slant-shelf, gravity feed magazine commonly employed in canned or bottled beverage vending machines, such as disclosed in U.S. Pat. No. 3,938,700, issued Feb. 17, 1976, for instance, cylindrical articles are stored in parallel storage racks inclined to the horizontal and generally aligned for gravitational movements of articles from front to back of the vending machine. Articles are discharged from the storage racks into a vertically extending drop chute that communicates at its lower end with an inclined delivery chute via a curvilinear guideway so that the cylindrical articles exiting from the lower end of the drop chute transit along the curvilinear guideway to the linear and downwardly sloping delivery chute which is blocked at its lower end by an article vending mechanism adapted to dispense articles one-by-one to a discharge hopper or vending stage in response to customer deposit of an appropriate coin value for a selected article.

Serious problems arise in the utilization of such a slant shelf magazine in that the weight of the articles in the vertical drop chute often crushes the lower articles, while the transition of such weight via the curvilinear guideway and discharge chute imposes heavy loads on the vend mechanism which cause undo wear of parts in such mechanism and in many cases jam the vend mechanism in an open position whereby the articles may be freely released or "jackpotted" to the customer without the intended coin deposit and article selection functions being performed.

SUMMARY OF THE INVENTION

In brief, the present invention alleviates the foregoing "jackpotting" and related problems by reducing the forces imposed on the vend mechanism.

To this end the present invention comprises a rigid deflector plate interposed in the path of vertical movement for articles gravitationally descending in the drop chute. Such deflector serves to change the path movement of the articles causing the same to move into a reentrantly curved guideway that is formed to direct articles away from the vend mechanism such that a substantial proportion of the weight and impact of the descending articles is absorbed by the guide chute prior to their entry into the downwardly sloping delivery chute. As a consequence the gravitational force exerted on the articles in the delivery chute is small enough to insure gravitational movement of the articles down the incline of the delivery chute while allowing the vend mechanism to properly operate to insure regulated delivery and release of articles one-by-one with minimum wear on the vend mechanism parts.

An important object of this invention is to provide an improved slant shelf magazine structure for use in automatic vending machines which dispense generally cylindrical articles.

Another important object of this invention is to provide an improved slant shelf magazine for vending machines as set out in the preceding object in which articles descend along a vertical path to a downwardly inclined delivery chute having a vending mechanism interposed in the movement path of the articles and in which the gravitational impact of articles imposed on the vending mechanism is materially reduced.

Still another important object of this invention is to provide a slant shelf magazine for automatic coin controlled vending machines in which articles stored on downwardly sloping slant shelves are released to a vertically oriented drop chute which communicates with a reversely downwardly sloping discharge chute; the interconnection between the drop chute and the discharge chute being such as to cause movement of the articles away from the vend mechanism disposed at the lower end of the discharge chute whereby to materially reduce or eliminate over burdening gravity forces imposed on the vend mechanism by descending articles.

Having thus described the present invention, the above and further objects, features and advantages thereof will be recognized by those skilled in the art from the hereinafter set forth description of the best mode presently contemplated for carrying out this invention so as to enable persons skilled in the art to practice the same, particularly the preferred embodiment thereof as illustrated in the accompanying drawings.

IN THE DRAWINGS

FIG. 1 is a front elevation of a typical automatic can vending machine embodying a slant shelf magazine in accordance with this invention; and FIG. 2 is an enlarged partial cross sectional view taken substantially along vantage line 2—2 of FIG. 1 and looking in the direction of the arrows thereon to illustrate the organization of slant shelf magazine parts according to this invention.

DESCRIPTION OF THE PREFERRED EMBODIMENT

Figure 1:
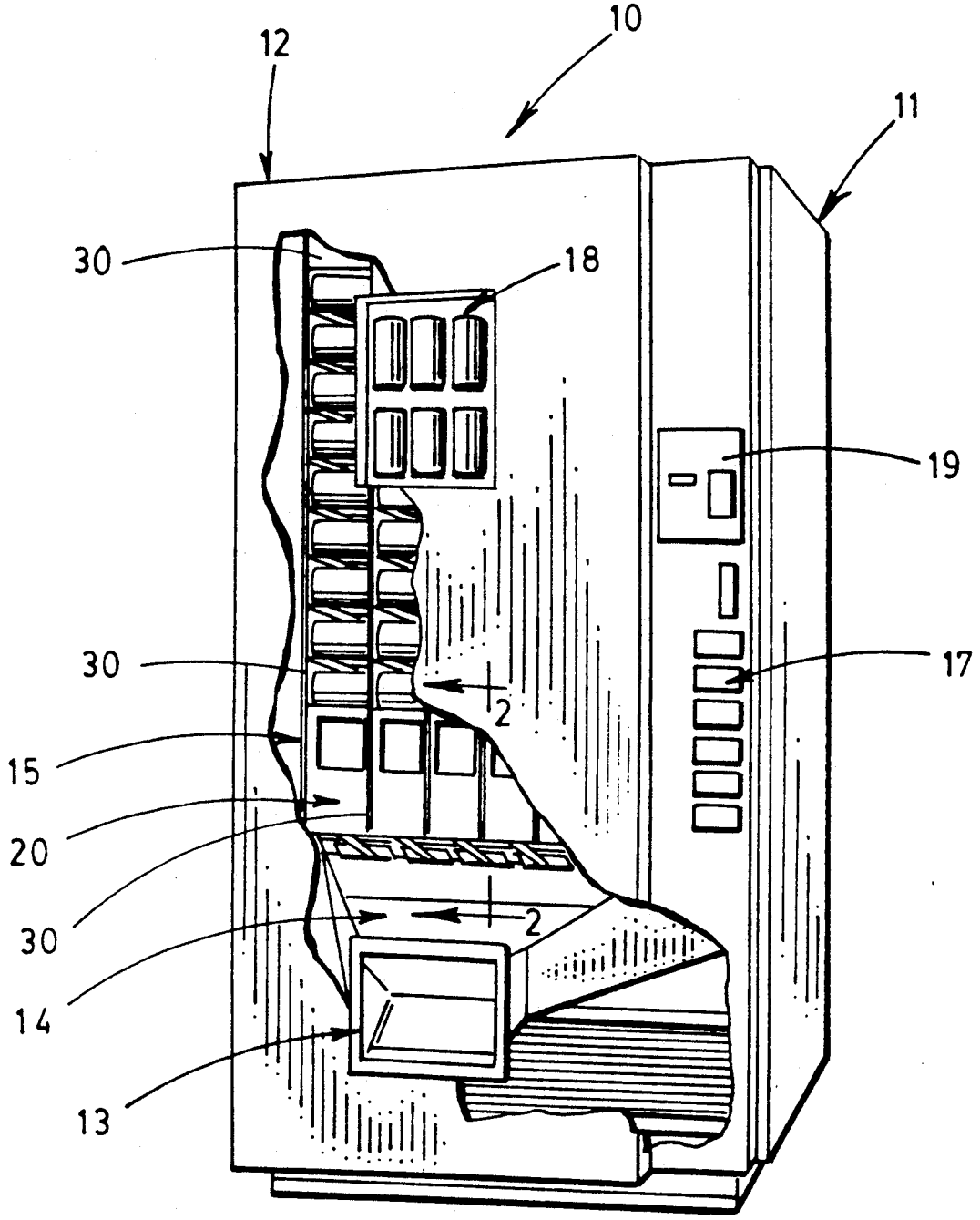

Turning now to the features of a preferred embodiment of this invention, reference is made to FIG. 1 of the drawings from which it will be recognized that a typical can beverage vending machine, indicated generally at 10, includes an exterior upright cabinet 11 having insulated enclosing walls and provided with a hinged front door or panel 12 equipped with a vending stage 13 which communicates with an interiorly disposed discharge hopper 14 located beneath a plurality of vertically oriented, laterally adjacent storage magazine sections 15 in the cabinet's interior. Plural selector push buttons or switch operators 17 are provided along one side of the front door panel; each associated with a particular can product shown in a centrally disposed display 18. A coin receptor 19 is provided adjacent the selector push buttons for the reception of customer deposited coin values in accordance with the price of the product selected.

Figure 2:
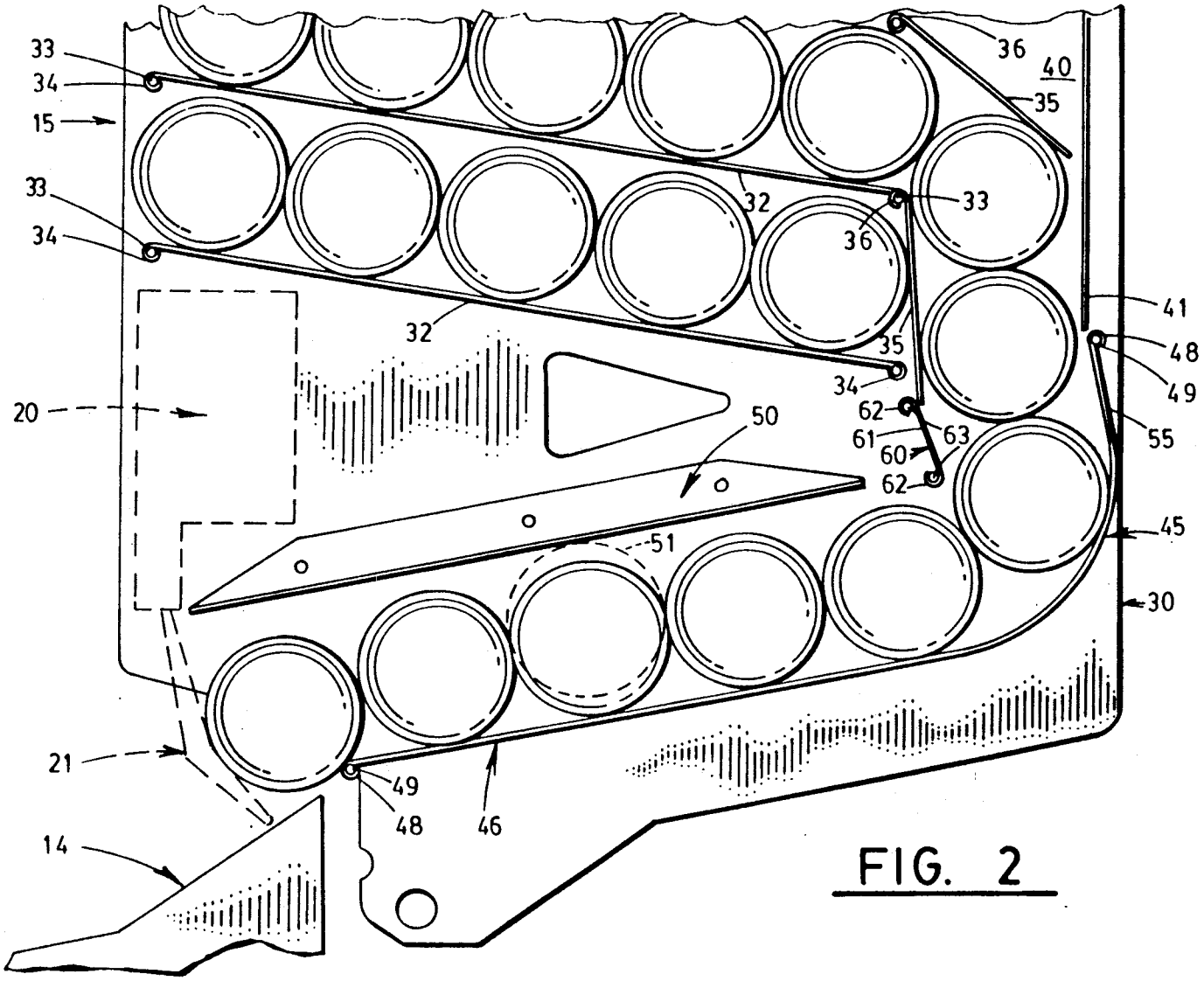

Referring now to FIG. 2 of the drawings, it will be understood that at the base or bottom end of each of the several storage magazine sections 15 an individual vending mechanism 20 is provided for regulating the dispensing of articles from its associated magazine section. While numerous vending mechanisms are known and available for this purpose, the particular vend mechanism 20 illustrated in the drawings is in accordance with the teachings of U.S. Pat. No. 3,613,947 issued Oct. 19, 1971, wherein a solenoid actuated tongue member 21 is disposed in blocking relationship to cylindrical articles discharged from a magazine section 15. Mechanism 20 is adapted to selectively release articles one-by-one for delivery to the vending stage 13 via the hopper 14.

Turning now to the particulars of the improved magazine according to this invention, FIG. 2 of the drawings shows the arrangement of parts at the lower end of a slant shelf magazine whereby the objectives of this invention are achieved. As there shown, each storage magazine section 15 comprises a pair of parallel spaced vertical side walls, such as wall 30 shown in FIG. 2; it being understood that laterally adjacent magazine sections 15 share a common side wall 30 in the overall side-by-side assembly of a plurality of such magazine sections. Plural inclined storage shelves 32 formulate superposed storage chutes disposed between adjacent side walls 30 and serve to laterally space the latter uniformly. Horizontal tie rods 33 pass through walls 30 and tubular portions 34 formed at the opposite ends of shelves 32 to fix the shelves in place and unify the magazine assembly. As shown the several shelves slope downwardly from front to back of the magazine assembly to promote gravitational movement of cylindrical articles, such as canned beverages, toward the rear of the vending machine. Each storage shelf except the uppermost one has a barrier gate 35 mounted across its lowermost end; such gates being formed with tubular ears 36 at the upper ends thereof through which tie rods 33 pass so that the several gates are pivotally moveable under the weight of cans stored on associated shelves 32.

Located opposite the lower ends of the storage shelves and the barrier gates thereon, is a vertical drop chute, indicated generally at 40, which is enclosed by gates 35, rear wall 41 and by parallel side walls 30. Canned articles gravitate vertically from successive storage chutes formulated by the shelves 32 and drop into chute 40 for eventual discharge from the magazine as will appear hereinafter. As cans are depleted from the drop chute, clearing a barrier gate 35, cans are released from an associated storage chute.

The lower end of drop chute 40, communicates openly with the upper end of a curvilinear guideway 45 which leads to a downwardly sloping discharge chute 46 sloping at a reverse incline or direction from the storage shelves, i.e., from rear to front of the magazine. As shown the guideway 45 and discharge chute 46 are formed as a single piece or strip of metal 47 having tubular ends 48 receptive of and held in place by tie rods 49 as in the mounting of the shelves 32.

To complete the discharge chute a pair of linear guide rails 50, of rigid construction, are fastened in opposing registration and in overlying parallelism with the chute 46; such rails being fixed to the opposing side walls 30 of the magazine section and serving to prevent cylindrical cans in the discharge chute from escaping upwardly therepast, as indicated by the dotted line showing of can 51 in FIG. 2.

As previously noted, a vend mechanism 20 is positioned across the lower end of the discharge chute 46 to dispense articles one-by-one. When the magazine is loaded, i.e., all storage shelves and the vertical drop chute are filled with cans, the gravitational load of the cans in the drop and discharge chutes, in particular, may be sufficient to crush one or more cans near the lower end of the drop chute or jam the vend mechanism and permit the same to "jackpot" the magazine contents while producing excessive wear of the vend mechanism parts. To avoid this undesirable occurrence, the guideway 45 according to this invention is formed reentrantly with a rearwardly directed, reverse curvature, i.e., out of tangential alignment with the rear wall 41 of the drop chute so that a generally linear end portion 55 of the guideway 45 intersects the plane of the vertical drop chute wall 41 at an acute angle as shown in FIG. 2.

In addition to the noted rearward or recessive curvature of the guideway as above noted, a rigid deflector 60 is mounted interferingly across the front side of the vertical drop chute and comprises a planar plate 61 having cylindrical ears 62, 62 at its opposite ends receptive of tie rods 63, 63 which extend between adjacent magazine side walls 32 and serve to fix the deflector in operating position. It will be noted that deflector 60 is angularly inclined to the vertical, in converging relationship with the linear portion 55 of the guideway 45 and is located to interfere with the lower end of the gate 35 associated with the lowermost storage shelf 32. This arrangement causes gate 35 to depend into the vertical drop chute interior so that the such gate and deflector 60 cooperate to alter the vertical downward movement path of overdisposed cans in the drop chute, deflecting the same rearwardly toward the reentrantly curved guideway 45.

As a consequence of this arrangement, cans descending from the vertical drop chute are positively deflected rearwardly against the guideway curve thereby initially moving away from the vend mechanism and then toward the entrance to the discharge chute. The guideway serves to take up or absorb much of the vertical load impact of the cans stacked in the drop chute so that cans proceeding along the discharge chute do so under only a partial horizontal component of the vertical gravity load of the cans in the drop chute. In this manner the load imposed on the vend mechanism is greatly reduced to avoid any tendency of the can load to jam the vend mechanism. This materially prolongs the wear life of the vend mechanism and circumvents the undesirable "jackpotting" of the magazine. Also, due to the reduced vertical load, cans opposite the lower end of the drop chute, no longer are subjected to crushing vertical loads from the over disposed cans.

From the foregoing it is believed that those skilled in the art will readily recognize and appreciate the novel advancement of the present invention over the prior art and will understand that while the same has herein been described in association with a particular preferred embodiment of the invention illustrated in the accompanying drawings, various changes, modifications and substitutions of equivalents may be made therein without departing from the spirit and scope of this invention which is intended to be unlimited by the foregoing except as may appear in the following appended claims.

The embodiments of the invention in which an exclusive property or privilege is claims are defined as follows:

1. A magazine for an automatic, coin controlled vending machine adapted to dispense cylindrical articles, such as canned and bottled beverages, comprising:

a plurality of horizontally inclined superposed storage racks adapted to store articles thereon, a vertical drop chute opposite the lower ends of said storage racks for receiving articles released therefrom and including a vertical rear wall for guiding said articles along a vertical free falling movement path, a horizontally inclined discharge chute having an upper end receptive of articles gravitating from said drop chute, a vend mechanism blocking the lower end of said discharge chute and operable to release articles therefrom one-by-one, and means for transferring articles between the lower end of said drop chute and the upper end of said discharge chute comprising, a reentrantly curved guideway located and extending rearwardly of said rear wall and operable to materially alter the vertical movement path of articles exiting from said drop chute by causing the articles to move horizontally out of said movement path and away from said drop chute and vend mechanism followed by reverse horizontal movement thereof toward said discharge chute.

2. The combination of claim 1, and rigid stationary deflector means traversing the lower end of said drop chute and operable to laterally deflect articles transversely away from said drop chute and into said guideway.

3. The combination of claim 1 wherein said storage racks slope downwardly from front to back of the vending machine, said discharge chute slopes downwardly from back to front of said machine and said guideway operates to move said articles recessively toward the back of said machine and behind said drop chute followed by reverse movement thereof toward said discharge chute.

4. The combination of claim 1 wherein said discharge chute and guideway are integral, and the upper end of said guideway is aligned non-tangentially to the vertical rear wall of said drop chute.

5. In a slant-shelf magazine for a coin controlled vending machine in which cylindrical articles are stored in plural, horizontally inclined, superposed storage racks adapted to gravitationally release articles to a vertical drop chute opposite the lower ends of said racks whereby to supply articles to a horizontally inclined discharge chute which is blocked at it's lower end by a vend mechanism operable to release articles therefrom one-by-one, improved means for transferring articles from said drop chute to said delivery chute while materially reducing the gravity load of articles on said vend mechanism, comprising: a guideway adjacent the lower end of said drop chute, comprising a reentrant portion mounted to extend recessively rearward of said drop chute, and stationary deflector means at the lower end of said drop chute for interferingly engaging each of said articles as it moves therepast to positively redirect the same horizontally into said guideway whereby the latter causes said articles to move horizontally away from said drop chute and vend mechanism before reversely moving toward said discharge chute thereby to reduce the gravitational load of said articles imposed on said vend mechanism.

* * * * *